US007481494B2

(12) United States Patent
Sagstuen

(10) Patent No.: US 7,481,494 B2
(45) Date of Patent: Jan. 27, 2009

(54) ADJUSTABLE CHAIR ARRANGEMENT

(75) Inventor: Morten Sagstuen, Lillehammer (NO)

(73) Assignee: Handicare Produksjon AS, Lillehammer (NO)

( * ) Notice: Subject to any disclaimer, the term of this patent is extended or adjusted under 35 U.S.C. 154(b) by 302 days.

(21) Appl. No.: 10/527,162

(22) PCT Filed: Sep. 8, 2003

(86) PCT No.: PCT/NO03/00310

§ 371 (c)(1),
(2), (4) Date: Mar. 9, 2005

(87) PCT Pub. No.: WO2004/021834

PCT Pub. Date: Mar. 18, 2004

(65) Prior Publication Data

US 2006/0152054 A1 Jul. 13, 2006

(30) Foreign Application Priority Data

Sep. 9, 2002 (NO) ..... 20024304

(51) Int. Cl.
*A47C 1/035* (2006.01)
*A47C 1/02* (2006.01)

(52) U.S. Cl. ..... 297/316; 297/325; 297/327; 297/340; 297/300.4

(58) Field of Classification Search ..... 297/325, 297/327, 340, 354.1, 351.12, 320, 302.3, 297/316, 300.4, 81, 87
See application file for complete search history.

(56) References Cited

U.S. PATENT DOCUMENTS

| | | | | |
|---|---|---|---|---|
| 5,108,148 | A * | 4/1992 | Henke | 297/81 |
| 5,297,021 | A * | 3/1994 | Koerlin et al. | 700/56 |
| 5,423,594 | A * | 6/1995 | Hancock et al. | 297/300.2 |
| 2003/0001420 | A1 * | 1/2003 | Koepke et al. | 297/440.15 |

FOREIGN PATENT DOCUMENTS

| | | |
|---|---|---|
| GB | 1414175 | 11/1975 |
| NO | 300754 | 7/1997 |
| WO | 9203950 | 3/1992 |

* cited by examiner

*Primary Examiner*—David Dunn
*Assistant Examiner*—Tania Abraham
(74) *Attorney, Agent, or Firm*—Young & Thompson

(57) ABSTRACT

A wheelchair includes a seat and a back that are pivotally supported in two side members and are kinematically interconnected in such manner that an angle between the seat and the back will increase when the back is swivelled backwards about its pivotal support in the side members, which kinematic connection comprises a link connection between the seat and the back. The link connection is in the form of a link arm arranged under the respective pivot supports of the seat and the back so that the distance between the back pivot support and the back link arm connection is less than the distance between the seat pivot support and the seat link arm connection, and that the axis of rotation of the seat through the seat's pivot support in the side members passes essentially through or close to the user's center of gravity.

12 Claims, 2 Drawing Sheets

ADJUSTABLE CHAIR ARRANGEMENT

FIELD OF THE INVENTION

The present invention relates to an adjustable chair.

BACKGROUND OF THE INVENTION

As examples of the prior art, reference is made in particular to GB Patent No. 1278501, DE Patent No. 3822877, U.S. Pat. No. 4,759,561 and a chair marketed under the trademark STRESSLESS. The last mentioned chair type is characterised by, among others, the feature that the body's centre of gravity relative to the chair is maintained almost constant, usually close to or over the central column of the chair, if the chair is of the swivelling type. However, an important point with the known type of chair is that when the backrest is tilted backwards, the lower end of the chair back remains at the same level as the back edge of the chair seat. This is because the seat back and the chair seat are connected to each other at the lower edge of the chair back and the back edge of the chair seat respectively. When the chair user leans backwards in the chair, he may experience the sensation of the chair back apparently "climbing" a little up his back. When the user leans backwards, it is of course important that the neck rest and the like are felt to be approximately in the same place regardless of the sitting position.

This problem area is no less important in connection with adjustable wheelchairs, where it is usual to be able to adjust the back rest relative to a fixed seat or to allow the seat and the back to be rigidly connected to each other and to be tiltable or adjustable as one unit. Furthermore, it has been known in connection with adjustable wheelchairs that they require at least one stabiliser that projects backwards from the large wheelchair wheels in order to prevent the chair from tipping backwards when the chair user leans back in the chair.

In the aforementioned prior art chairs, a change of sitting position results in a major change of the body's centre of gravity.

Reference will also be made to NO 300754 wherein the chair back at a first point of support on each side thereof is pivotally connected to a respective side member of the chair and at a second point of support forms an articulated connection with a rear portion of the chair seat frame, and wherein the chair seat frame at a forward point of support on each side thereof is slidably connected to respective side members along a front, forward and upward sloping guide that is an integral part of the side member. The first point of support on the chair back is arranged to slide along a rear, forward and downward sloping guide in the side member, and the seat frame has on each side a rear point of support between the front point of support point and the second point of support for the chair back, the rear point of support forming a sliding connection with a guide in the respective side member, and central when seen in the longitudinal direction of the side member, and which is either horizontal or slightly forward and upward sloping. With this solution, a relatively limited change of the body's centre of gravity is obtained. Nevertheless, there are still deficiencies in this art which mean that there continues to be a great need for improvements in the field.

Accordingly, it has been an object of the present invention to provide an adjustable chair of the aforementioned type, wherein the aforementioned deficiencies both in ordinary adjustable chairs of this kind and especially in wheelchairs can be remedied. The primary object of the invention is to provide good sitting comfort in an adjustable chair of this kind, and when the invention is used in connection with a manual wheelchair, the otherwise good sitting comfort of the comfort wheelchair could be combined with the wheeling and transport properties of the active wheelchair. A particular object of the present invention in connection with a wheelchair is to combine an "active driving position" and a "passive resting position" in one and the same wheelchair.

DESCRIPTION OF THE INVENTION

The object of the present invention is, by means of a simple mechanism, to permit tilting of the seat and back with maximum retention of the centre of gravity of the user's body relative to the chair and the wheels.

This is accomplished in that the angle between the seat and the back is opened gradually whilst the angle of the seat is changed slightly more by means of a link mechanism with a transmission ratio, the axis of rotation for the seat being located in or close to the user's centre of gravity. When the user reclines, his body is turned about what is approximately the body's overall centre of gravity, which in a sitting position will be slightly forward of the user's stomach.

The advantages of using this system in a wheelchair where the seat unit is to be adjusted angularly relative to the rest of the chair are that:

The angle between the seat and the back is opened gradually when the seat unit is adjusted angularly relative to the main frame. This happens because of the transmission ratio.

The hinge point for the angular adjustment is close to the centre of gravity of the person, which in turn means that relatively little force is required to make this angular adjustment, which is a distinct advantage as the wheelchair user will often have weakened or atrophied muscles.

The hinge point for the back is relatively close to the hip joint, so that the back cushion does not slide relative to the user's back when it is angled.

The overall movement pattern of the seat unit when it is angled means that the user's arm will rest in a stable manner on the chair arm rest.

When the user reclines, his body turns about what is approximately the overall centre of gravity of his body, which in such a sitting position is slightly forward of the user's stomach.

This in turn means that the wheel base and the total length of the chair can be made shorter than in similar wheelchairs with such large angular adjustment of the seat unit. This in turn is a crucial if the chair is to wheel easily and be readily manoeuvrable for the user.

The system allows the user to erect the chair with a correct or desired weight distribution on the front and back wheels, and to be relatively sure that this will remain comparatively stable.

EMBODIMENTS

Figure 1:
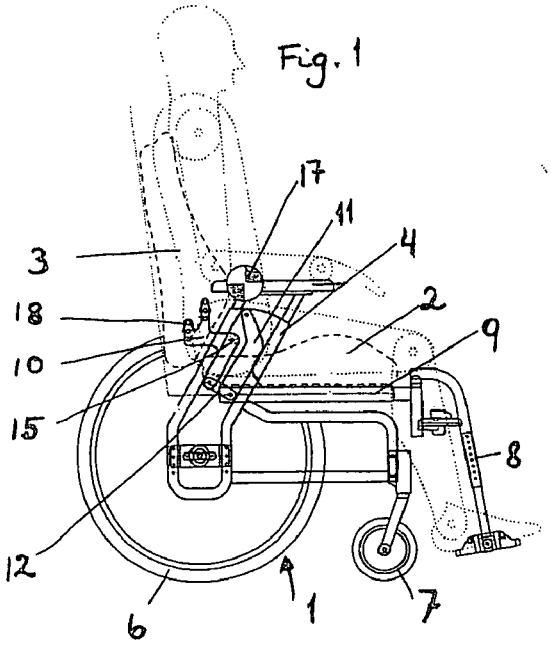
FIG. 1 is a schematic side view of a wheelchair according to the invention.
Figure 2:
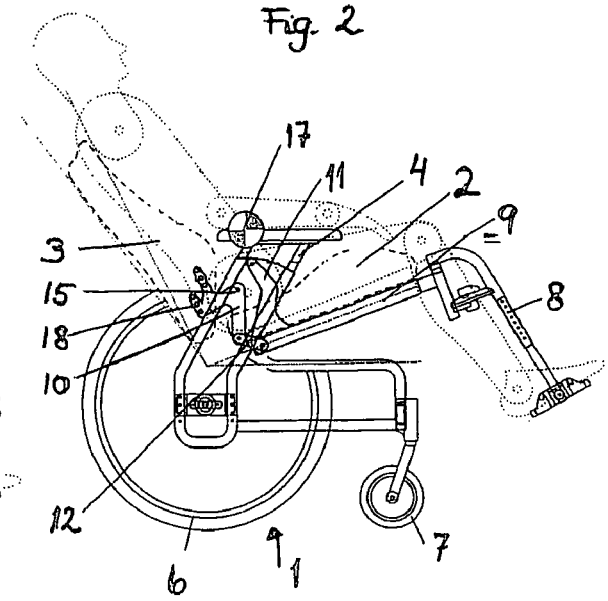
FIG. 2 is a schematic side view of the wheelchair in FIG. 1 in a tilted position.

FIGS. 1 and 2 show a wheelchair (1) comprising a seat (2) and a back (3) and side members (4) and (5). Furthermore, the wheelchair comprises two rear wheels (6) and two front support/guide wheels (7) and a footrest (8). The seat (2) is attached to a seat frame (9). A seat swivel fitting (11) is fastened to the seat frame (9) and a back swivel fitting (10) is fastened to the back (3). A link arm (12) connects the two swivel fittings (10, 11) via a link arm connection (13) to the back and a link arm connection (14) to the seat. (See also FIGS. 3 and 4). The swivel fittings (10, 11), a pair for each side member, (see FIG. 5), are fastened to the side members (4, 5) by means of the pivot support (15) of the back swivel fitting and the support (16) of the seat swivel fitting. The back swivel fitting (10) is fastened to the back (3) with fastening screws (18). The wheelchair user has been indicated in broken lines and the centre of gravity (17) of the user's body is clearly marked FIG. 1 shows the wheelchair in a normal, upright sitting position, and FIG. 2 shows the wheelchair in a tilted position.

Figure 3:
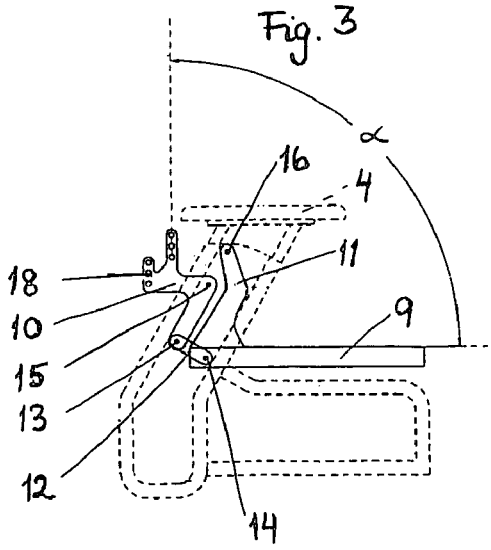
FIG. 3 shows the tilting mechanism used in FIGS. 2 and 3.
Figure 4:
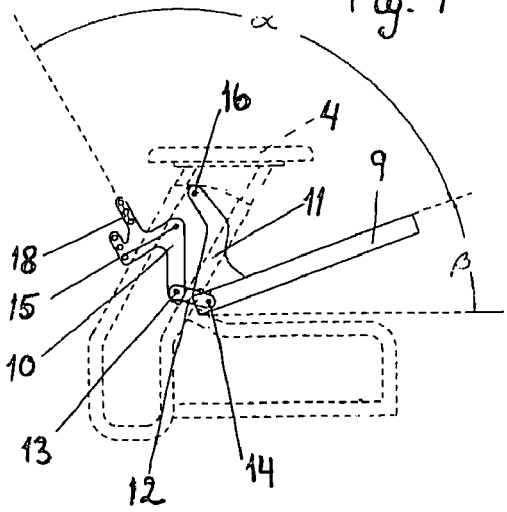
FIG. 4 shows the tilting mechanism in FIG. 3 in a tilted position as in FIG. 2.

FIGS. 3 and 4 show details of the chair according to the invention in a upright and tilted position respectively.

Figure 5:
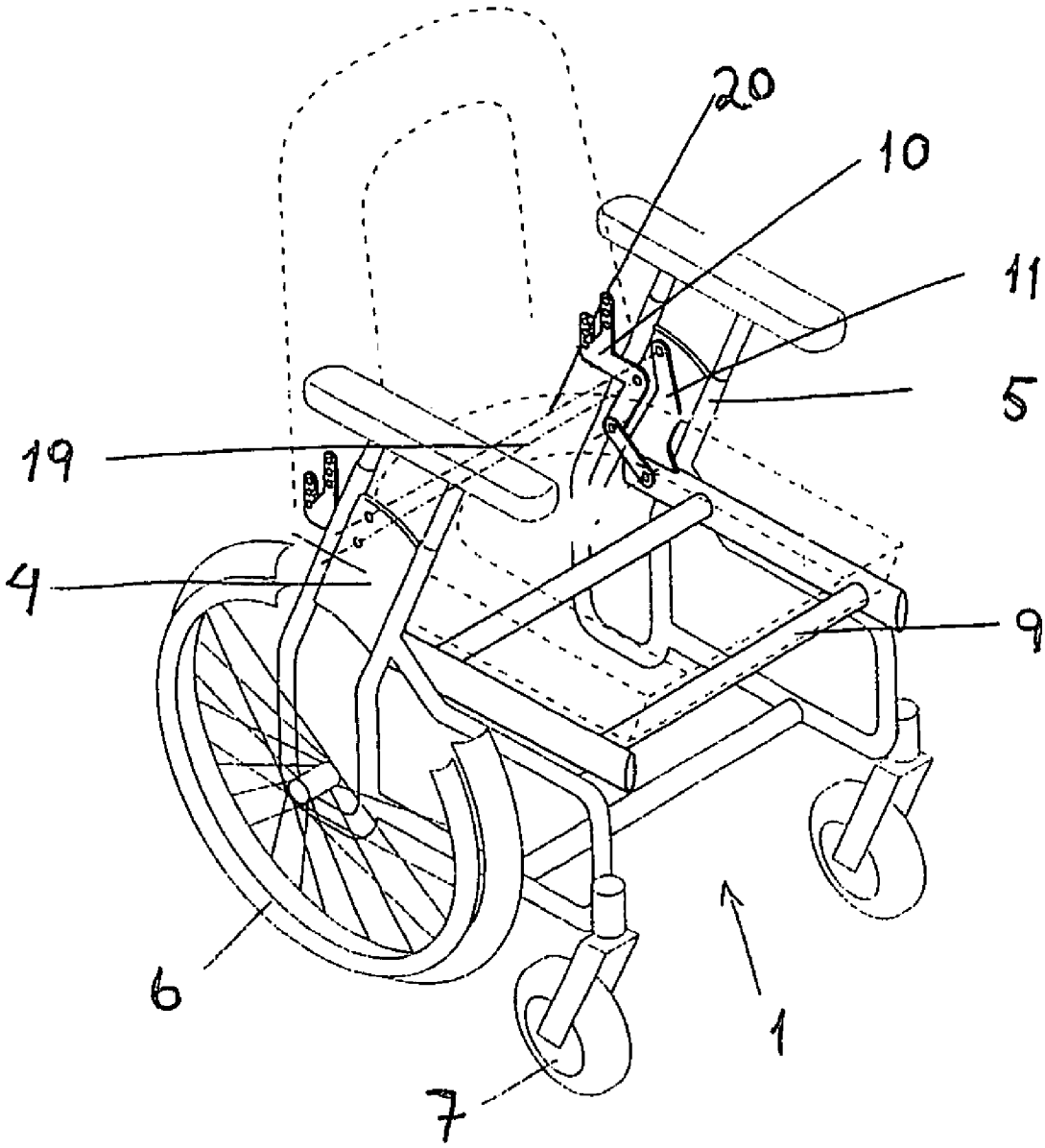
FIG. 5 is a schematic perspective view of the wheelchair.

FIG. 5 is a perspective view of the wheelchair with the axis of rotation for the back (19) and the axis of rotation for the seat (20) indicated on the drawing. The seat swivel fitting (11) projects up from the frame (9). The back swivel fitting (10) is L-shaped as shown in the figures.

As can be seen clearly from FIGS. 1-4, the link connection is in the form of a link arm (12) arranged under the respective pivot supports (16, 15) of the seat and the back, and the distance between the back pivot support (15) and the back link arm connection (13) is less than the distance between the seat pivot support (16) and the seat link arm connection (14). The link arm may optionally be made in the form of an adjustable link arm, for example, by providing it with a plurality of holes for the respective connections.

The axis of rotation (20) of the seat through the seat's pivot support (16) in the side members (4, 5) passes essentially through or close to the user's centre of gravity (17). Furthermore, the axis or rotation (19) of the back through the pivot support (15) of the back in the side members (4, 5) passes essentially through the user's hips.

It can be seen that the design of the chair is such that a transmission is obtained so that the angle $\alpha$ between the seat (2, 9) and the back (3) increases at the same time as the seat's (2, 9) angle $\beta$ increases from 0 as shown in FIGS. 3 and 4. The angle $\beta$ will be greater than the increase of angle $\alpha$. The angular deflection can be altered if the length ratio between the back swivel fitting and the seat swivel fitting is changed.

The wheelchair may have in a known way (not shown) a locking mechanism for locking the tilting position.

The invention claimed is:

1. An adjustable chair (1) arrangement, comprising:
a seat frame (9);
a seat (2) attached to the seat frame;
a back (3);
two side members (4, 5);
two rear wheels (6);
two front support-guide wheels (7);
a footrest (8);
a pair of seat swivel fittings (11) fastened to the seat frame (9);
a pair of back swivel fittings (10) fastened to the back (3);
a pair of first link arm connections (13);
a pair of second link arm connections (14);
a link arm (12) connecting each of the back swivel fittings and each of the seat swivel fittings via a respective one of the first link arm connections to the back and via a respective one of the second link arm connections to the seat;
a seat pivot support (16) for each seat swivel fitting;
a back pivot support (15) for each back swivel fitting,
one of the seat swivel fittings and one of the back swivel fittings fastened to a respective one of the side members by the back pivot support (15) of the one back swivel fitting and the seat pivot support (16) of the one seat swivel fitting;
a kinematic connection kinematically interconnecting the two side members to provide that an angle between the seat and the back will increase when the back is swivelled backwards about the respective back pivot support of the side members, wherein,
the kinematic connection comprises a link connection between the seat and the back,
the link connection is comprised of the link arm (12) arranged under the respective back and seat pivot supports (15, 16) and provide that a distance between the back pivot support (15) and the back link arm connection (13) is less than a distance between the seat pivot support (16) and the seat link arm connection (14).

2. An arrangement according to claim 1, wherein an axis of rotation (19) of the back through the back pivot support (15) in the side members is provided.

3. The adjustable chair (1) arrangement of claim 1, wherein the chair is a wheelchair.

4. The adjustable chair (1) arrangement of claim 1, wherein,
each seat swivel fitting (11) projects up from the frame (9), and
each back swivel fitting (10) is L-shaped.

5. The adjustable chair (1) arrangement of claim 1, wherein,
the link arm (12) is an adjustable link arm.

6. The adjustable chair (1) arrangement of claim 1, wherein,
an axis of rotation (20) of the seat through the seat pivot support (16) in the side members is provided.

7. An adjustable chair (1) arrangement, comprising:
a seat frame (9);
a seat (2) attached to the seat frame;
a back (3);
two side members (4, 5);
a pair of first link arm connections (13);
a pair of second link arm connections (14);
a pair of seat swivel fittings (11) fastened to the seat frame (9);
a pair of back swivel fittings (10) fastened to the back (3);
a link arm (12) connecting each of the back swivel fittings and each of the seat swivel fittings via a respective one of the first link arm connections to the back and via a respective one of the second link arm connections to the seat;
a seat pivot support (16) for each seat swivel fitting;
a back pivot support (15) for each back swivel fitting,
one of the seat swivel fittings and one of the back swivel fittings fastened to a respective one of the side members by the back pivot support (15) of the one back swivel fitting and the seat pivot support (16) of the one seat swivel fitting;
a kinematic connection kinematically interconnecting the two side members providing that an angle between the seat and the back will increase when the back is swivelled backwards about the respective back pivot support of the side members, wherein,
the kinematic connection comprises a link connection between the seat and the back, the link connection is comprised of the link arm (12) arranged under the respective back and seat pivot supports (15, 16) and provide that a distance between the back pivot support (15) and the back link arm connection (13) is less than a distance between the seat pivot support (16) and the seat link arm connection (14).

8. An arrangement according to claim 7, wherein an axis of rotation (19) of the back through the back pivot support (15) in the side members is provided.

9. The adjustable chair (1) arrangement of claim 7, wherein the chair is a wheelchair.

10. The adjustable chair (1) arrangement of claim 7, wherein, each seat swivel fitting (11) projects up from the frame (9), and each back swivel fitting (10) is L-shaped.

11. The adjustable chair (1) arrangement of claim 7, wherein, the link arm (12) is an adjustable link arm.

12. The adjustable chair (1) arrangement of claim 7, wherein, an axis of rotation (20) of the seat through the seat pivot support (16) in the side members is provided.

* * * * *